United States Patent [19]

Barnette

[11] Patent Number: 5,018,765

[45] Date of Patent: May 28, 1991

[54] AUXILIARY BINDER

[75] Inventor: Charles J. Barnette, Akron, Ohio

[73] Assignee: Kent Adhesive Products Co., Kent, Ohio

[21] Appl. No.: 447,590

[22] Filed: Dec. 8, 1989

[51] Int. Cl.[5] ..... B42D 1/02

[52] U.S. Cl. ..... 281/15.001; 40/359; 281/21.001; 412/15; 412/901

[58] Field of Search ..... 40/359, 360; 281/15.1, 281/21.1; 412/15, 901

[56] References Cited

U.S. PATENT DOCUMENTS

| | | | |
|---|---|---|---|
| 1,743,191 | 1/1930 | Charlton | 40/359 |
| 2,052,623 | 9/1936 | Harby | 40/359 X |
| 2,062,436 | 12/1936 | Yawman | 40/359 |
| 4,749,121 | 6/1988 | Barber et al. | 40/359 X |

FOREIGN PATENT DOCUMENTS

| | | | |
|---|---|---|---|
| 2751801 | 5/1979 | Fed. Rep. of Germany | 412/15 |

OTHER PUBLICATIONS

Butterfly Closure Band-Aid by Johnson & Johnson circa 1980.

*Primary Examiner*—Paul A. Bell
*Attorney, Agent, or Firm*—Renner, Kenner, Greive, Bobak, Taylor & Weber

[57] ABSTRACT

An auxiliary binder for booklets consists of an adhesive laminate configured as a bow tie or dog bone. In one embodiment of the invention, a polyester base sheet is adhesively coated and receives thereon a backing sheet having a strip die cut longitudinally thereon. Removal of the strip of the backing sheet allows positioning of the auxiliary binder, and subsequent removal of portions of the backing sheet allows the binder the be affixed to the booklet. In another embodiment of the invention, an adhesively coated base sheet receives a reinforced strip longitudinally along a center portion thereof. The reinforced strip has its own carrier and release liner which, when removed, allows the reinforcement to be adhered to a booklet. Subsequent removal of a liner covering the remainder of the adhesive of the base sheet allows the base sheet to be further secured to the booklet.

16 Claims, 2 Drawing Sheets

AUXILIARY BINDER

TECHNICAL FIELD

The invention herein resides in the art of binding articles and, more particularly, to a supplemental or auxiliary binder for magazines, pamphlets, booklets and the like. The invention has particular applicability to such printed materials which are originally bound by the use of staples or other piercing elements passing through the pages at the spine of the book.

BACKGROUND ART

It is well known that magazines, pamphlets, booklets and the like are typically bound by staples or other suitable stitching means. Each sheet of the booklet upon which the pages are printed is typically the width of two such pages and, by being imprinted on the front and back of the sheet, carries the print of four such pages. In assembling booklets of this type, the printed pages are assembled on a cover of substantially the same length and width as the sheets carrying the printed pages. The assembly is then stapled down a center line dividing the printed pages from each other upon the sheets. The composite is then folded onto itself, presenting a magazine, pamphlet, or booklet which is centrally bound down the spine thereof, the cover and sheets of the booklets all being maintained by the securing staples.

This binding technique is attractive because of its inexpensive nature. Accordingly, it is particularly suitable for use in binding periodicals, magazines, school booklets, pamphlets, and the like. However, printed materials which are bound in this manner are given to separation of the sheets bearing the pages. Typically, the open end of the staple is at the interior of the book at the center of the pages. During use of the books, the flexing exerted on the staples allows the page sheets and cover to loosen and eventually disassemble. As is well known to those who have used such printed materials, the center pages and covers first come loose, destroying the utility of the booklet. Such destruction is most apparent with printed materials which are used extensively, such as in schools, libraries, and the like. Once the pages and cover become separated from each other, it is not soon before the total utility of the book is destroyed by lost pages or the like.

In light of the foregoing, there is clearly a need in the art for an inexpensive yet reliable auxiliary binder which can be used to supplement the staple binding of such printed materials.

DISCLOSURE OF INVENTION

In light of the foregoing, it is a first aspect of the invention to provide an auxiliary binder for booklets comprising a pressure sensitive adhesive laminate.

Another aspect of the invention is the provision of an auxiliary binder for booklets which binds the totality of the booklet from the cover to the center page and engages all pages therebetween.

Still a further aspect of the invention is the provision of an auxiliary binder for booklets which is adaptable to implementation with booklets of various sizes and thicknesses.

Still a further aspect of the invention is the provision of an auxiliary binder for booklets which is easy to manufacture and use, and which is cost effective in implementation.

The foregoing and other aspects of the invention which will become apparent as the detailed description proceeds are achieved by an auxiliary binder for booklets, comprising: a first sheet of material having an adhesive applied to one surface thereof; and a second sheet of material releasably secured to said adhesive and forming a laminate, said second sheet of material being split through a thickness thereof between first and second ends thereof.

Other aspects of the invention are attained by an auxiliary binder for booklets, comprising: a base sheet having an adhesive coating on one surface thereof; and a release sheet received by said adhesive coating, said release sheet being cut to define a strip extending from one end of said release sheet to another.

Other aspects of the invention are attained by an auxiliary binder for booklets, comprising: a base sheet having an adhesive coating on one surface thereof; a release sheet received upon said adhesive of said base sheet, said release sheet being split and separated longitudinally from one end thereof to another; and a reinforcing strip received by said sheet at said split separating said release sheet.

DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
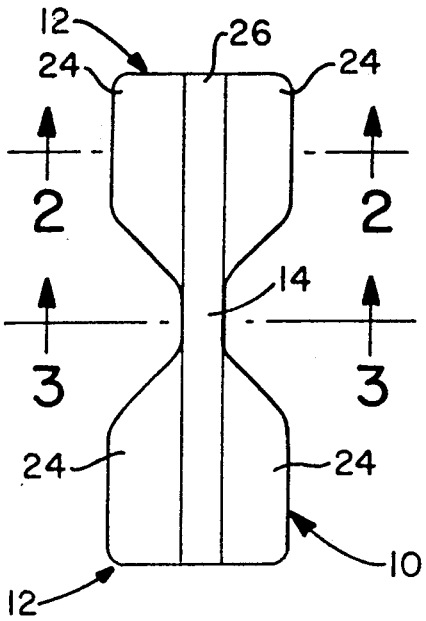
FIG. 1 is a top plan view of a first embodiment of the auxiliary binder of the invention.
Figure 2:
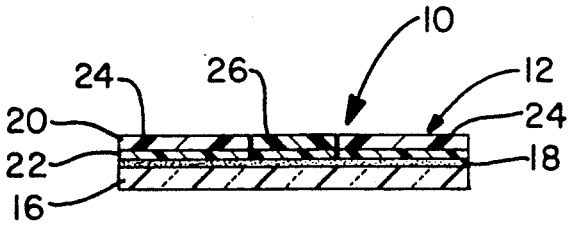
FIG. 2 is a cross sectional view of the laminate of FIG. 1 taken along the line 2—2.
Figure 3:
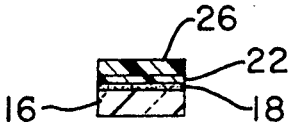
FIG. 3 is a cross sectional view of the laminate of FIG. 1 taken along the line 3—3.

Referring now to the drawings and more particularly FIGS. 1-3, it can be seen that an auxiliary binder according to the invention is designated generally by the numeral 10. As shown, the binder 10 comprises an adhesive laminate structure in a bow tie or dog bone configuration. As shown, enlarged end pieces 12, substantially rectangular in nature, are positioned on opposed ends of an intermediate strip 14. As shown, the enlarged end pieces 12 have an oblique engagement with the intermediate strip 14, rather than an orthogonal interconnection which would result in a true rectangular configuration of the end pieces 12.

The auxiliary binder 10 comprises a base sheet 16 which is preferably of a clear plastic film such as polyester. The base sheet 16 receives a coating of adhesive 18 thereon. A carrier or backing liner 20 is removably attached to the adhesive layer 18. As will be appreciated by those skilled in the art, the liner 20 has a release layer 22 thereon which can be of any suitable nature as, for example, a silicone coating.

As is apparent in FIGS. 1-3, the carrier 20 is die cut or otherwise split along the length thereof to define a liner strip 26 which is the width of the intermediate strip 14 and which is congruent with that intermediate strip. The liner strip 26 extends the entire length of the laminate of the auxiliary binder 10, as shown.

It will be readily appreciated by those skilled in the art that the auxiliary binder 10 may be readily manufactured from a web of laminate material comprising the base sheet 16, adhesive layer 18, carrier or backing liner 20 and release layer 22. A web of material so configured can be die cut such that the liner strips 26 are cut only through the thickness of the liner 20 and release layer 22, without adversely impacting the adhesive layer 18 or base sheet 16. Additional die cutting may then be performed to cut the auxiliary binder 10 from the laminate web in the dog bone or bow tie configuration as shown in FIG. 1. As a result, each of the auxiliary binders 10 comprise congruent base sheets 16 and carriers 20, with the carrier 20 being divided into five separate pieces. The liner strip 26 separating the four side pieces 24.

Figure 4:
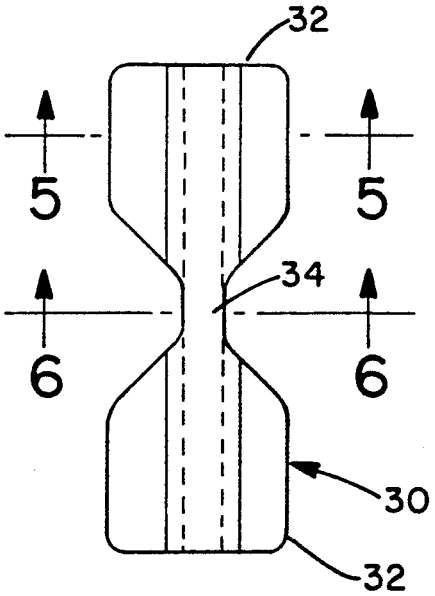
FIG. 4 is a top plan view of a second embodiment of the auxiliary binder of the invention.
Figure 5:
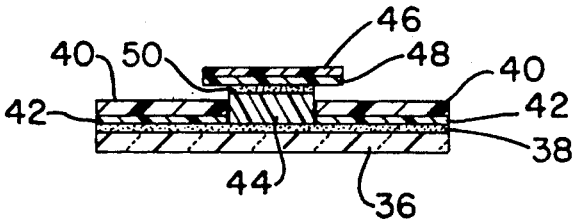
FIG. 5 is a cross sectional view of the laminate of FIG. 4 taken along the line 5—5.
Figure 6:
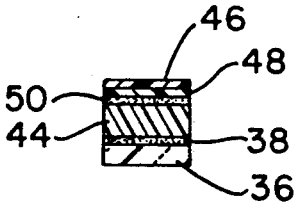
FIG. 6 is a cross sectional view of the laminate of FIG. 4 taken along the line 6—6.

A second embodiment of the auxiliary binder of the invention is designated by the numeral 30 and shown in FIGS. 4-6. Again, the auxiliary binder 30 is preferably in a bow tie or dog bone configuration and comprises a pressure sensitive adhesive laminate. Generally rectangular end pieces 32 are positioned at opposite ends of an intermediate narrow interconnecting piece or neck 34. A base sheet 36, preferably of clear polyester film, receives an adhesive coating layer 38 to which is adhered a carrier or backing liner 40 having a release coating 42 thereon. In the embodiment of FIGS. 4-6, a reinforcing strip 44 is adhered to the adhesive layer 38 of the base sheet 36 from one end thereof to the other, and being congruent with the intermediate interconnecting neck piece 34 as it passes thereover. A carrier or liner 46 having a release layer 48 thereon is attached to an adhesive layer 50 received upon the reinforcing strip 44. As shown, the liner 46 and release layer 48 extend substantially over the reinforcing strip 44 and over the liner 40.

It will be readily appreciated that manufacture of the auxiliary binder 30 may be easily achieved from a web of laminate comprising a base sheet 36 having an adhesive layer 38 thereon and receiving a carrier or backing liner 40 having a release coating 42 thereon. First, the liner 40 and release layer 42 are die cut through the thickness thereof along strips slightly wider than the width of the reinforcing strip 44. These die cut strips of the carrier 40 and release coating 42 are removed, exposing the adhesive layer 38 therealong. Next, the reinforcing strip 44 carrying an adhesive layer 50 and receiving thereon the liner 46 and release layer 48 is placed onto the exposed adhesive layer 38 where the strips of carrier 40 and release coating 42 were previously removed. Next, the dog bone or bow tie configurations of the auxiliary binders 30 are die cut from the web to result in the configuration shown in FIG. 4. It will be appreciated that this die cut operation cuts completely through the laminate as shown in cross section in FIG. 5, cutting through layers 36-40 in certain areas, and the totality of layers 36-40, 46, 48 in others.

Figure 7:
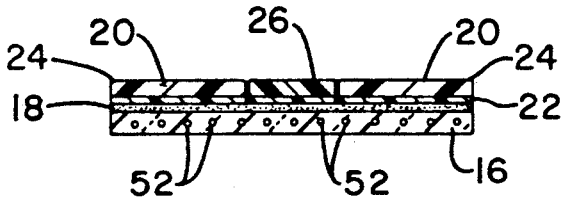
FIG. 7 is a cross sectional view of the first embodiment of the invention in which the binder includes reinforcing longitudinal fibers.
Figure 8:
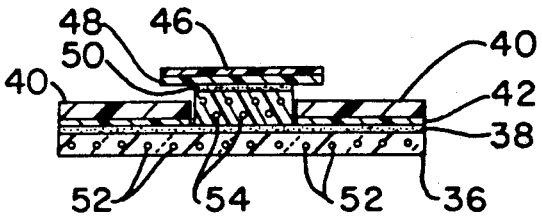
FIG. 8 is a cross sectional view of the second embodiment of the invention in which the binder includes reinforcing longitudinal fibers.

As shown in FIG. 7, the base 16 of laminate 10 may be reinforced by means of longitudinal reinforcing fibers or strands passing through the plastic film. Similarly, the backing sheet 36 of the auxiliary binder 30 may be reinforced by the longitudinal reinforcing fibers or strands 52, while the reinforcing strip 44 may be characterized by similar longitudinal reinforcing fibers or strands 54. The strands 52-54 may be of any suitable nature such as nylon, Kevlar, or the like.

Figure 9:
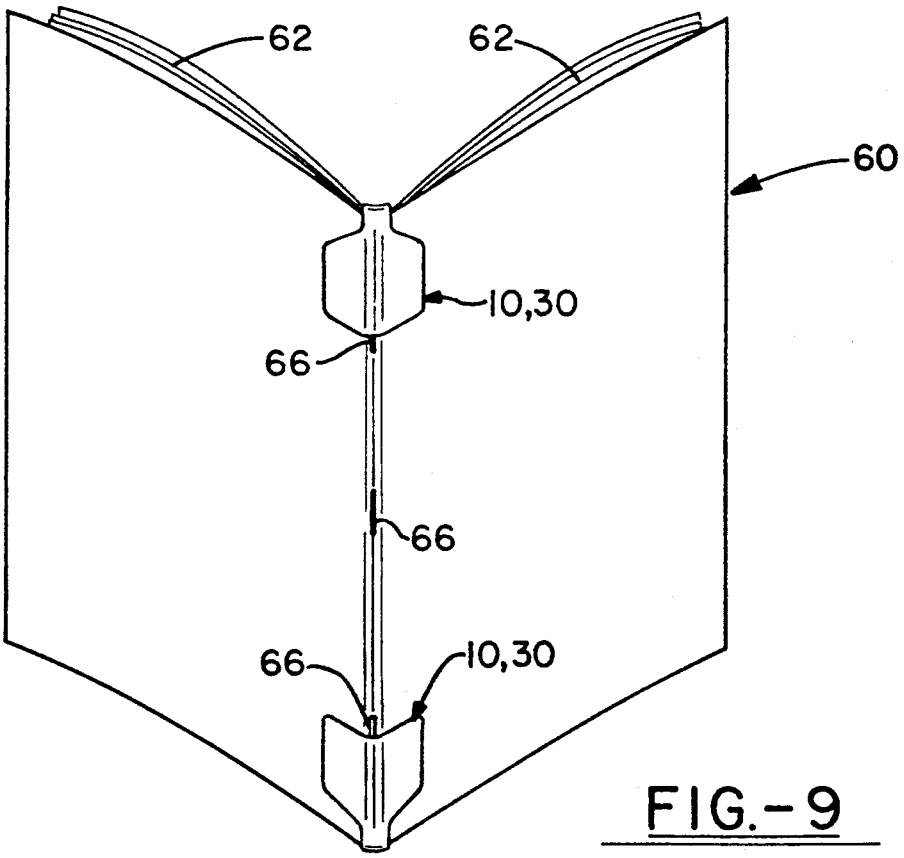
FIG. 9 is an illustrative view of a book reinforced by the structure of the invention.

With reference to FIG. 9, the utilization of the auxiliary binders 10, 30 can be see. As shown, a booklet 60 consists of a plurality of sheets or pages 62 over which is maintained an outside cover 64, with the cover 64 and pages 62 being bound by centrally positioned staples 66 passing therethrough. In the event that the cover 64 and pages 62 begin to loosen or separate, or to prevent such separation beforehand, either of the auxiliary binders 10-30 can be employed. Use of the auxiliary binder 10 simply requires slight bending of the laminate at the liner strip 26 such that the strip 26 can be secured and removed. The intermediate strip 14 is then placed over the top edge of the booklet 60, extending from the cover 64 to the innermost of the pages 62. The adhesive 18 exposed by removal of the strip 26 is then secured to the cover 64, top edges of the pages 62 and surface of the innermost sheet of the pages 62. Subsequently, the liner side pieces 24 are sequentially removed and the exposed adhesive 18 of the base sheet 16 is then adhered to the cover 64 or innermost sheet of the pages 62. Accordingly, a bond across the top edge of the booklet 60 at the center spine thereof is made by the base sheet 16 and adhesive layer 18. The procedure is then repeated at the bottom edge of the book 16 at the spine as shown in FIG. 9. The result is a booklet 60 in which the cover 64 and innermost sheet of the pages 62 are adhesively bound together, with the intermediate strip 14 traversing the thickness of the booklet 60. The auxiliary binder 30 is used in a similar fashion. In this case, the exposed edges of the liner 46 and release layer 48 are quickly and easily secured and removed from the adhesive layer 50 of the reinforcing strip 44. The auxiliary binder 30 is then positioned over the top edge of the book 60 as discussed above, with the adhesive layer 50 engaging the center spine of the cover 64, the top edges of the pages 62, and the center portion of the innermost sheet of the pages 62. The four side portions of the carrier or backing liner 40 are then sequentially removed and the exposed adhesive appropriately adhered to either the cover 64 or face of an innermost page of the pages 62. The process is repeated at the bottom of the booklet 60 to secure the bottom portion thereof.

It should be readily appreciated that various combinations of materials can be employed for achieving the structure of the instant invention and the various embodiments thereof. The auxiliary binder 10 may comprise a base sheet 16 of one mil polyester sheet. Such material demonstrates high tensile strength and visual clarity. The adhesive 18 is preferably an acid free ph neutral acrylic adhesive of the permanent type. If it is found that the polyester of the base sheet 16 is insufficient to withstand the requisite flexing, it can be reinforced with the fibers 52 as discussed above.

The auxiliary binder 30 is substantially similar to the binder 10 but for the addition of a reinforcing strip 44. In the preferred embodiment of the invention, base sheet 36 is one mil polyester sheet, while the strip 44 is five mil polyester. Accordingly, the intermediate interconnecting neck 34 comprises a strip of polyester having a thickness of approximately six mils. This thickness allows for enhanced strength longitudinally from one end of the binder 30 to the other along the central axis thereof, while allowing the side portions of the binder 30 to be thin and flexible and therefore readily bend as required when the booklet is opened and closed. Again, the polyester employed is of high tensile strength and visual clarity, and the adhesive is acid free, ph neutral, permanent acrylic adhesive. If necessary, the reinforcing fiber or strands 52, 54 can also be employed in the auxiliary binder 30.

It will further be appreciated that the size of the physical structure of the auxiliary binders 10, 30 can vary. The length of the intermediate strips 14, 34 are typically dependent upon the thickness of the booklets to be secured. The length of such intermediate strips 14, 34 will typically be greater than the thickness of such books. In a preferred embodiment of the invention, the overall length of the auxiliary binder is 1–4 inches, and preferably 3 inches. The overall width is between ½–2 inches, and preferably 1 inch. The interconnecting neck or strips 14, 34 are 1/16–¼ inch, preferably ⅛ inch wide, while being ¼–¾ inch long, and preferably ½ inch long.

Thus it can be seen that the objects of the invention have been satisfied by the structure presented above. While in accordance with the patent statutes only the best mode and preferred embodiment of the invention has been presented and described in detail, the invention is not limited thereto or thereby. Accordingly, for an appreciation of the true scope and breadth of the invention reference should be made to the following claims.

What is claimed is:

1. An auxiliary binder for booklets comprising;

a first sheet of material having an adhesive applied to one surface thereof; and a second sheet of material releasably secured to said adhesive and forming a laminate, said second sheet of material being split through a thickness thereof between first and second ends thereof, said laminate comprising a pair of enlarged sections interconnected by a narrow strip, said split in said second sheet being congruent with said narrow strip, said material of said second sheet being removed at said split and an elongated strip of material being secured to said adhesive of said first sheet of material at said split, said elongated strip of material being adhesively coated on a surface opposite a surface received by said adhesive of said first sheet of material.

2. The auxiliary binder according to claim 1, further comprising a liner strip releasably attached to said elongated strip, said liner strip being wider than said elongated strip of material in said enlarged sections and overlapping said elongated strip thereat.

3. The auxiliary binder according to claim 1, wherein said elongated strip of material is stronger than said first sheet of material.

4. The auxiliary binder according to claim 3, wherein said elongated strip of material is thicker than said first sheet of material.

5. An auxiliary binder for booklets comprising:

a first sheet of material having an adhesive applied to one surface thereof; and a second sheet of material releasably secured to said adhesive and forming a laminate, said second sheet of material being split through a thickness thereof between first and second ends thereof, said laminate comprising a pair of enlarged sections interconnected by a narrow strip, said split in said second sheet being congruent with said narrow strip, said second sheet of material being divided into five pieces by said split, a pair of pieces at each of said enlarged sections of said laminate and a piece congruent with said strip and extending between said first and second ends of said second sheet of material and separating said pairs of pieces at each of said enlarged sections.

6. The auxiliary binder according to claim 5, wherein said first and second sheets are congruent.

7. The auxiliary binder according to claim 5, wherein said first sheet of material comprises reinforcement strands extending longitudinally therethrough.

8. The auxiliary binder according to claim 5, wherein said material of said second sheet is removed at said split and an elongated strip of material is secured to said adhesive of said first sheet of material at said split.

9. The auxiliary binder according to claim 8, wherein said elongated strip of material is stronger than said first sheet of material.

10. The auxiliary binder according to claim 9, wherein said elongated strip of material is thicker than said first sheet of material.

11. The auxiliary binder according to claim 8, wherein said elongated strip of material is adhesively coated on a surface opposite a surface received by said adhesive of said first sheet of material.

12. The auxiliary binder according to claim 11, further comprising a liner strip releasably attached to said elongated strip, said liner strip being wider than said elongated strip of material in said enlarged sections and overlapping said elongated strip thereat.

13. An auxiliary binder for booklets, comprising:

a base sheet having an adhesive coating on one surface thereof;

a release sheet received upon said adhesive of said base sheet, said release sheet being split and separated longitudinally from one end thereof to another; and a reinforcing strip received by said base sheet at said split separating said release sheet, said reinforcing strip being adhesively coated on a side thereof opposite a side received by said base sheet.

14. The auxiliary binder according to claim 13, wherein said reinforcing strip is thicker than said base strip.

15. The auxiliary binder according to claim 14, wherein said reinforcing strip receives a release strip on said adhesively coated side.

16. The auxiliary binder according to claim 15, wherein said base sheet, release sheet, reinforcing strip, and release strip comprise a laminate having a pair of enlarged ends interconnected by a neck, said neck being substantially congruous with said reinforcing strip between said enlarged ends.

* * * * *